United States Patent [19]

Maeda et al.

[11] Patent Number: 4,462,793

[45] Date of Patent: Jul. 31, 1984

[54] ROTARY KILN AND METHOD OF USING SUCH A KILN

[75] Inventors: Takuya Maeda; Tsutomu Yamada, both of Kobe; Mitsuharu Kishimoto, Miki; Atsuyoshi Kubotani, Kobe, all of Japan

[73] Assignee: Kawasaki Jukogyo Kabushiki Kaisha, Kobe, Japan

[21] Appl. No.: 404,128

[22] Filed: Aug. 2, 1982

[30] Foreign Application Priority Data

Aug. 3, 1981 [JP] Japan ..... 56-122129

[51] Int. Cl.[3] ..... C21B 13/00; C21B 11/06; F27B 15/00; F27B 7/36

[52] U.S. Cl. ..... 432/14; 75/36; 266/173; 432/105; 432/106

[58] Field of Search ..... 432/14, 103, 105, 106; 75/36; 266/173

[56] References Cited

U.S. PATENT DOCUMENTS

| | | | |
|---|---|---|---|
| 1,829,438 | 10/1931 | Coley | 75/36 |
| 2,621,160 | 12/1952 | Johnson et al. | 432/14 |
| 3,155,380 | 11/1964 | Lessard | 432/106 |
| 3,170,786 | 2/1965 | Moklebust | 75/34 |
| 3,182,980 | 5/1965 | Helfrich | 432/109 |
| 3,206,299 | 9/1965 | Senior et al. | 75/11 |
| 3,228,670 | 1/1966 | Moklebust | 266/20 |
| 3,295,930 | 1/1967 | Swanson et al. | 432/106 |
| 3,817,697 | 6/1974 | Parobek | 432/105 |
| 3,879,193 | 4/1975 | Gunter | 75/35 |

FOREIGN PATENT DOCUMENTS

| | | | |
|---|---|---|---|
| 0056931 | 12/1981 | European Pat. Off. . | |
| 2306415 | 3/1976 | France | 432/106 |
| 281129 | 12/1927 | United Kingdom . | |
| 317952 | 8/1929 | United Kingdom . | |

*Primary Examiner*—John J. Camby

*Attorney, Agent, or Firm*—Marshall, O'Toole, Gerstein, Murray & Bicknell

[57] ABSTRACT

This disclosure relates to a rotary kiln for heating and calcining lime, waste, etc. and to a method of direct reduction of metal oxide using such a kiln. A cylindrical outer shell is mounted for rotation on its axis, and a stationary inner tube extends into the interior of the shell. Fuel and/or combustion air flow passages extend within the tube, and burner nozzles are supported by the tube and are connected to the passages. The tube is concentrically or eccentrically mounted adjacent the upper side of the space within the shell, thereby positioning the burner nozzles at the optimum positions.

11 Claims, 10 Drawing Figures

PRIOR ART

ROTARY KILN AND METHOD OF USING SUCH A KILN

DETAILED DESCRIPTION

This invention relates to improvements in a rotary kiln for heating and calcining lime, waste, etc., and to a method of direct reduction of metal oxide by use of such a kiln.

FIG. 1 of the accompanying drawings shows a prior art rotary kiln, which includes a cylindrical shell 2 that is lined with a refractory or fire-resisting liner 7, the shell being rotatable at an acute angle to the horizontal. To supply the shell with combustion air, air fans 1 are installed on the outside of the shell 2 and force air through a plurality of burner tubes 4. The tubes 4 extend radially inwardly through the wall of the shell 2 and the liner 7, and project nearly to the axis of rotation of the kiln. A main burner 24 is mounted at the lower end of the shell and an auxiliary burner nozzle 5 is provided on the inner end of each burner tube 4.

The shell 2 is charged from its upper end with material 8 such as iron ore, lime and waste, which is stirred by the rotation of the shell 2 and moved toward its lower end while it is being heated by the burners.

Because the burner tubes 4 rotate together with the shell 2, the auxiliary burner nozzles 5 must be positioned around the axis of rotation of the kiln and away from the material 8 at the shell bottom, and the burner tubes 4 are repeatedly in intermittent contact with the material as the shell 2 rotates. This is a considerable cause of failure due to heat and friction, so that the tubes 4 cannot withstand long use. Also, protion of the hot gas is likely to blow through the central space within the shell without sufficient contribution to heating the material 8 at the bottom of the shell.

FIG. 2 shows another prior art rotary kiln construction having burner nozzles 6 arranged on the circumference of a shell but not projecting radially inwardly from a refractory liner 7. The nozzles 6 are supplied through tubes 3 alternately with fuel and air. The nozzles 6 require means for opening and closing them to alternately supply them with fuel when they are immersed in material 8 and with air when they are not immersed, as the shell 2 rotates. Also, the nozzles 6 repeatedly receive heat loads from the heated material 8 and hot gas, as the shell rotates. These result in a rotary kiln having a complex construction and a greater number of factors leading to failure.

It is an object of this invention to provide a rotary kiln that precisely controls the temperature of the hot gas above the material to be heated within the space within the shell and the temperature of the material, and prevents the burner tube from failing because of thermal fatigue caused by the periodic change of the heat load, thereby lengthening their working lives.

It is another object to provide a method of direct reduction of metal oxide by the use of such a rotary kiln.

A rotary kiln according to this invention, comprises at least one cylindrical shell rotatably mounted at an angle to the horizontal, and is characterized by including at least one inner tube fixedly supported independentaly of the shell and extending axially into the shell, said tube being covered on its outer periphery by refractory matter, said shell and inner tube forming a space therebetween, one or more flow passages provided within said inner tube, and one or more burner nozzles located in said space, said nozzles being supported by said inner tube and connected with one or more of said passages.

A method of direct reduction of meatl oxide utilizing apparatus according to this invention comprises the steps of charging said space in the rotary kiln with material, which mainly includes metal oxide and carbon-containing material as a reduction agent, supplying said nozzles with fuel and/or oxygen-containing gas, such as air, from outside said shell, and heating the material by combustion heat from said nozzles, from a main burner provided in said kiln, and from heat reflected by said refractory matter.

Preferred embodiments of this invention are described below in detail with reference to the accompanying drawings, wherein.

Figure 3:
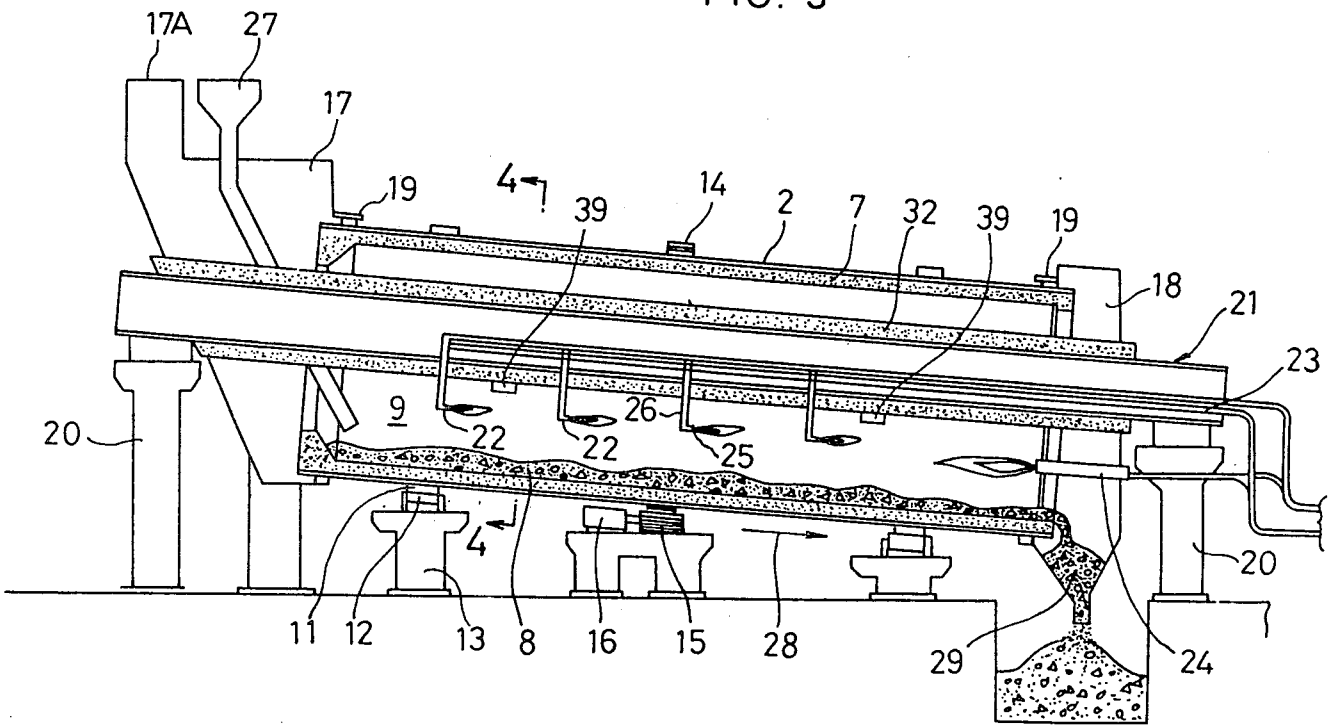
FIG. 3 is a side view partially in longitudinal section of a rotary kiln embodying the present invention.
Figure 5A:
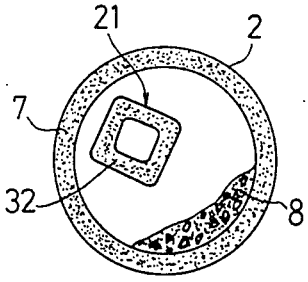
FIGS. 5A to 5D, 6, 7 and 9 are cross-sectional views similar to FIG. 4 but showing alternative embodiments of the kiln.
Figure 5B:
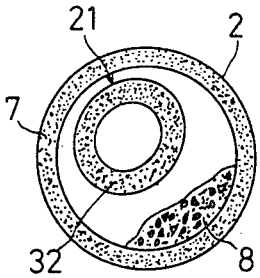
Figure 5C:
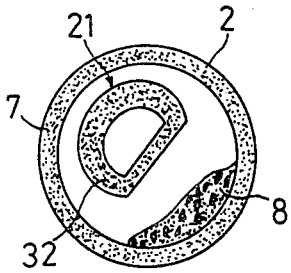
Figure 5D:
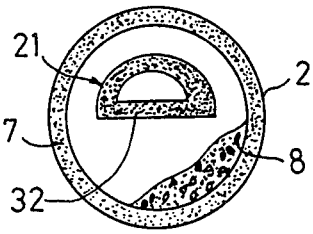

Referring to FIG. 3, a rotary kiln according to the invention includes an outer cylindrical shell 2 that is open at both ends and is lined with refractory matter 7. The shell 2 is rotatably supported by bases 13 such that its axis lies at an acute angle from the horizontal. The shell 2 is supported by rollers 11 which, with their supports 12, are mounted on the bases 13, and a ring gear 14 fixed to the outer surface of shell 2 meshes with a gear 15 driven by a motor 16 for rotating the shell on its axis.

The shell 2 is provided with a gas exhaust hood 17 and a heated material discharge hood 18 connected respectively to the upper and lower ends of the shell, and the shell has a rotatable gas-tight connection through seals 19 with the inside of the inner ends of the hoods 17 and 18. The gas hood 17 has an upper outlet 17A for exhausting the waste gas, and a charge chute 27 extends through the exhaust gas hood 17 and into the shell 2 for charging the shell with material. The material hood 18 has a bottom opening 29 for discharging the product, ash, etc.

Extending substantially axially through the shell 2 is an inner tube 21 that is fixedly supported at both open ends by bases 20 which are external of the shell 2, so that the shell 2 rotates around and independently of the inner tube 21. The tube 21 is positioned concentrically or eccentrically from the axis of the shell 2. If the tube is eccentrically mounted, it is located adjacent the upper part of the space in the shell to provide additional space near the bottom for material to be treated. The outer surface of the tube 21 is covered with refractory matter 32.

Within the inner tube 21 extends pipes 23 for conducting combustible fuel and/or oxygen containing gas for combustion. The pipes 23 also have branches extending externally or outside of the tube 21 to one or more main burners 24 which are located below the tube 21 and inside the shell 2, adjacent the lower or discharge end of the shell.

Figure 4:
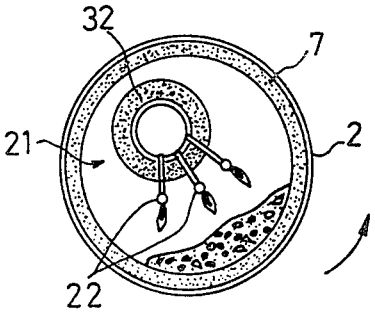
FIG. 4 is a cross-sectional view on line 4—4 of FIG. 3.

The pipes 23 also extend into the tube 21, and extending generally transversely from the pipes 23 are nozzle tubes 26 which run radially outwardly and generally downwardly through the tube 21 and the refractory matter 32 and into the space 9 between the tube 21 and the shell 2. The tubes 26 are located at intervals, both axially (FIG. 3) and angularly or circumferentially (FIG. 4). The tubes 26 are secured to the tube 21.

To the outer end of each tube 26 is connected a burner nozzle 22, the forward end 25 of which is directed either axially toward the discharge end (FIG. 3) or radially (FIG. 4) of the shell.

The length, the number and the intervals between the tubes 26 may be determined to produce an optimum temperature profile of the gas above the material being treated so that the material can be heated optimumly as required by the process.

Referring again to FIG. 3, the shell 2 is charged substantially continuously through the chute 27 with the material 8, which mainly includes metal oxide such as iron ore and carbon-containing material as its reductant. The material 8 effects a reducing reaction by absorbing the heat radiated from the gas above the material, which is heated by the burner 24 and the nozzles 22, and by the heat radiated from the refractory matter 32 on the inner tube 21, while the material 8 moves downwardly toward the burner 24 as shown by an arrow 28 effecting a refinement into metal iron. The movement is caused by the rotation and the slope of the shell 2. The material 8 is finally heated at the lower end portion of shell 2 by the burner 24, before being discharged therefrom through the discharge outlet 29 of the hood 18. The gas is discharged through the upper hood outlet 17A.

The amount of fuel and/or combustion air injected from the nozzles 22 may be preset or controlled according to the progress of the reaction along the longitudinal length within the shell 2, to equalize the temperature distribution or to maintain proper temperature distribution longitudinally within the shell 2, thereby improving the efficiency of the reduction process.

Unlike the conventional kiln with auxiliary burners provided on the shell, the burner nozzles 22 are fixed to the inner tube 21 at the positions most suitable for the process, to provide a rotary kiln having a high productivity. Also, the heat and mechanical loads on the nozzle tubes 26 are constant and do not alternate thereby reducing the probability of their failure.

The cross section of inner tube 21 is not necessarily a circular shape, but may have any other shape such as those shown in FIGS. 5A to 5D. Two or more inner tubes 21 may be provided if necessary. It is not necessarily required that the inner tube 21 extend the entire distance of the shell length, because the cylinder may be supported in cantilever fashion from one end.

Figure 6:
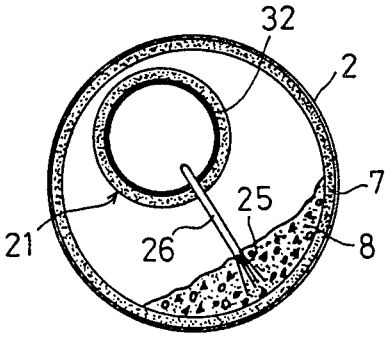

As shown in FIG. 6, one or more of nozzle tubes 26 may be sized to be long enough that the whole length or only the forward end 25 of the nozzle is always immersed in the material 8 for the purpose of effectively heating the material 8. Consequently, the tubes 26 are not subjected to heat load changes as are those mentioned herein in the description of the prior art, thereby reducing the probability of burner nozzle failure. When the material 8 contains sufficient combustible volatile matter, it may be sufficient to eject only air from the nozzles 22.

Figure 7:
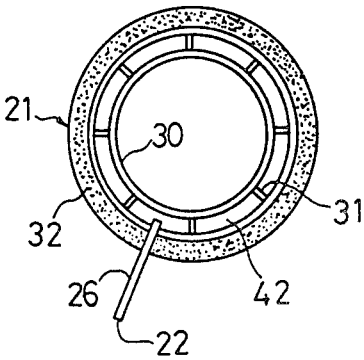

FIG. 7 shows another embodiment, wherein the inner tube 21 (the outer shell not being shown) is provided with an interior cyindrical jacket 30 on its inner surface. The jacket 30 is radially spaced from the tube 21 and radial partitions 31 are provided to form circumferential chambers or passages 42 inside the cylindrical 21. One or more of the passages 42 may be provided to pass fuel, combustion air and/or gas to burner nozzles 22 in place of the pipes 23 of FIG. 3. A portion of the heat in the space 9 within the shell 2 is transferred through the refractory matter 32 to the inner tube 21, thereby preheating the fuel or combustion air passing through the jacket passages 42, to promote the combustion air at the nozzles 22. One or more of the passages 42 may instead be used to pass a coolant such as water to prevent the inner tube 21 from overheating.

Figure 8:
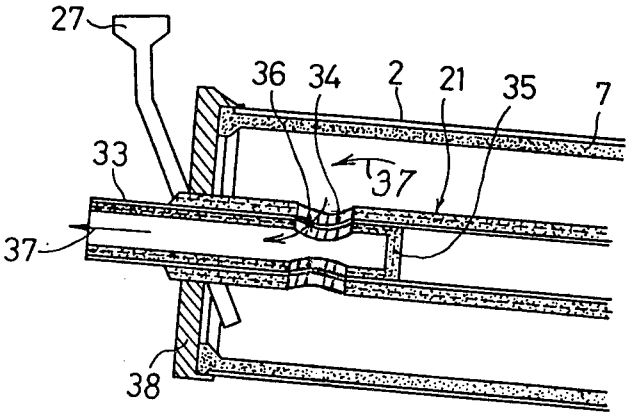
FIG. 8 is a fragmentary view in longitudinal section showing another embodiment of the invention.

FIG. 8 shows another embodiment of this invention. One end portion of the inner tube 21 has a hot gas exhaust tube 33 fixed thereinside, and is formed with a vent 34 through its cylindrical wall. The tube 33 is closed at its inner end by a blind plug 35, and also has vent 36 through its cylindrical wall that is aligned with the vent 34. The adjacent end of the shell 2 is closed by a cover disc 38, in place of the hood 17 shown in FIG. 3, and a seal is provided between the disc 38 and the cylinder 21, so that the shell can rotate in a gas-tight fit. Hot gas within the shell 2 will flow, as shown by arrows 37, through the vents 34 and 36 into the tube 33 and then be supplied to suitable apparatus that utilizes its high heat energy.

As shown in FIG. 3, the inner tube 21 may have a device 39 attached to its outer periphery for controlling the kiln operation. The device 39 may, for example, be a temperature detector, a gas sampling tube, a material sampling tube, and/or a window for observing the space within the shell. The control means 39 can thus be positioned suitably close to the material 8 but without contacting it, to obtain an accurate measurement and to increase the life of the control means, as compared with those conventionally provided on the inner wall of the shell.

Figure 9:
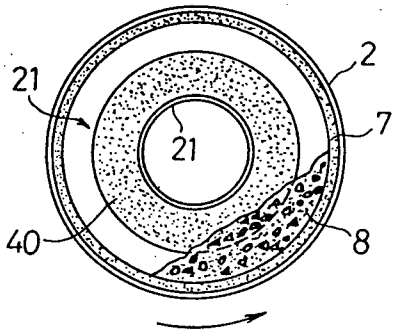

FIG. 9 shows a circular enlargement 40 such as a spiral layer of refractory matter, which may be fixed around the outer periphery of the inner tube 21, regardless of the existence of the burner nozzles 22. If the spiral 40 is sized to be out of contact with the material 8, the gas within the shell 2 flows spirally to equalize the temperature within the shell. If the spiral 40 contacts the material 8 as illustrated in FIG. 9, the upper portion of the material can be stirred with the rotation of the shell 2.

If the direction of the spiral 40 is directed to promote the material flow in the direction that is opposite the normal gravity flow of the material 8, the upper portion of material 8 may remain for a longer time within the shell 2 than would be the case with a normal rotary kiln. This is suitable when it is desired to lengthen the time for heating only large lumps or masses of material 8 which are difficult to heat sufficiently because large pieces normally tend to float on the top surface of the material.

Figure 10:
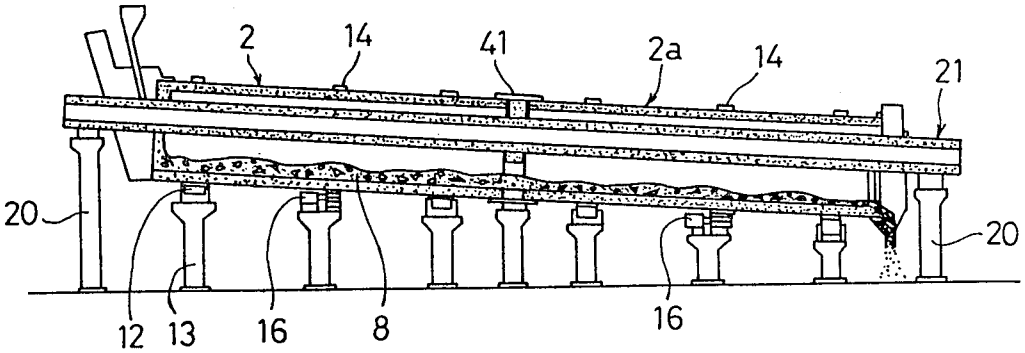
FIG. 10 is a side view partially in longitudinal section showing a still further embodiment of the invention.

FIG. 10 shows a further embodiment comprising two or more shells 2 and **2*a* that are connected end to end, through which one inner tube 21 extends. Interposed between the two shells is an intermediate support 41 that is secured to the base, which forms a gas-tight seal between the shells but does not prevent the shells from rotating relative to each other. The stationary intermediate support 41 extends through the space between the shells and the tube 21 and firmly engages the inner tube 21. As shown in FIG. 10, the part of the support 41 that is in the upper portion of the space may be solid, but the part that is in the lower portion of the space is perforated to enable the material 8 to flow downwardly through the shells. The support 41 is provided to keep the extra long tube 21 from deforming due to its weight and the heat. The relative rotational speeds and/or diameters of the plural shells 2 and 2***a* may be different to change the rates of movement of the material 8 in the two shells and subsequently the quantities of heat received by the material at the earlier and later stages of the calcining or reduction process, resulting in the optimum operation of the process. Separate drive motors 16 are provided for the two shells.

Since the mixing ratio of the constituents of the material 8 may vary along the longitudinal locations within the shell 2, or the material may contain an unbalanced ratio of amounts of metal oxide and reductant as the process proceeds, the inner tube 21 may be provided with means such as a nozzle (not shown) for supplying additional amounts of material 8, such as reductant through charging nozzles suitably distributed in the inner tube 21 to locations where the additional material is required, thereby promoting the reduction reaction.

The condition of the reaction may be detected by providing a plurality of control devices 39 (FIG. 3) along the inner tube 21, and additional material can be supplied through the inner tube 21 in response to the measured values, to produce an efficient reducing reaction.

Figure 1:
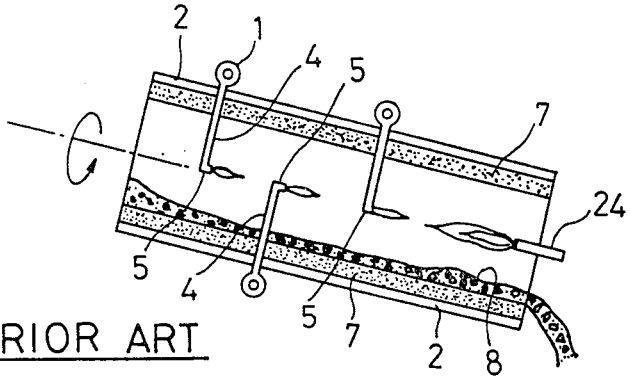
FIGS. 1 and 2 are views of two prior art rotary kilns.
Figure 2:
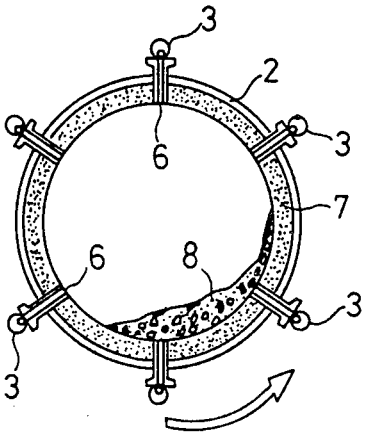
PRIOR ART FIG. 2

With reference to FIG. 1, air and combustible fuel are delivered to the main burner 24.

What is claimed is:

1. A rotary kiln for direct reduction using a solid reducing agent, said kiln comprising at least one substantially cylindrical shell rotatably mounted at an angle to the horizontal plane, at least one inner tube extending longitudinally into said shell and fixedly supported relative to said shell at both ends of said tube externally of said shell, said tube being covered over substantially its outer periphery by a refractory layer, said shell and tube forming a space therebetween, at least one flow passage for oxygen-containing gas provided within said tube, at least one nozzle tube supported by said inner tube, said nozzle tube extending radially through the wall of said inner tube and said refractory layer and connected with said passage, a burner nozzle located in said space, said nozzle being connected with said nozzle tube, and a temperature detector provided on the outside of said inner tube in said space.

2. A rotary kiln as in claim 1, wherein said inner tube is eccentrically positioned in said shell to form a greater space adjacent one side of said tube and within said shell, and said nozzle being located adjacent said greater space.

3. A rotary kiln as in claim 1 or 2, wherein said innner tube extends through and beyond the ends of said shell and is supported at both of its ends externally of said shell.

4. A rotary kiln as in claim 1 or 2, wherein at least two of said nozzles are provided at spaced intervals.

5. A rotary kiln as in claim 1 or 2, wherein at least two of said shells are provided, said two shells being positioned in end-to-end relation and having closely adjacent ends, and said inner tube extends through said shells, and an intermediate support secured to said closely adjacent ends and interconnecting said shells in end-to-end gas-tight fashion.

6. A rotary kiln as in claim 1 or 2, and further including a jacket provided inside said inner tube, said jacket and said tube forming flow passages therebetween.

7. A rotary kiln as in claim 1 or 2, and further including means connected to said tube and said shell for closing said shell at both ends in gas-tight fashion, and one end of said tube having passage means therein for discharging hot gas from within said space through said passage to outside said shell.

8. A rotary kiln as in claim 1 or 2, and further including sensing means secured on said inner tube for measuring the conditions of gas and materials in the said shell .

9. A rotary kiln as in claim 1 or 2, and further including means on said inner tube for supplying materials into the said space from outside said kiln.

10. A rotary kiln as in claim 5, wherein said intermediate support extends through said space and engages said inner tube and supports an intermediate portion of said tube.

11. A method of direct reduction using a rotary kiln and a solid reducing agent, said kiln including at least one substantially cylindrical shell rotatably mounted at an angle to the horizontal plane, at least one inner tube extending longitudinally into said shell and fixedly supported relative to said shell at both ends of said tube externally of said shell, said tube being covered over substantially its outer periphery by a refractory layer, said shell and tube forming a space therebetween, at least one flow passage provided within said tube, at least one nozzle tube supported by said inner tube, said nozzle tube extending radially through the wall of said inner tube and said refractory layer and connected with said passage, a burner nozzle located in said space and connected with said nozzle tube, and a temperature detector provided on the outside of said inner tube in said space; said method comprising the steps of charging said space with material that includes primarily metal oxide and carbon-containing material, injecting oxygen-containing gas into said space from said nozzle, heating the material by combustion heat from said nozzle and heat reflected by said refractory layer, detecting the temperature within said space by said detector, and controlling the amount of the injected gas to maintain proper temperature distribution within said shell.

* * * * *